US011041360B2

(12) United States Patent
Penno et al.

(10) Patent No.: US 11,041,360 B2
(45) Date of Patent: Jun. 22, 2021

(54) PRESSURE ACTUATED INFLOW CONTROL DEVICE

(71) Applicant: Halliburton Energy Services, Inc., Houston, TX (US)

(72) Inventors: Andrew David Penno, Porcheres (FR); Maxime P M Coffin, Frisco, TX (US); Thomas Jules Frosell, Irving, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/776,300

(22) PCT Filed: Apr. 18, 2017

(86) PCT No.: PCT/US2017/028088
§ 371 (c)(1),
(2) Date: May 15, 2018

(87) PCT Pub. No.: WO2018/194560
PCT Pub. Date: Oct. 25, 2018

(65) Prior Publication Data

US 2020/0256154 A1 Aug. 13, 2020

(51) Int. Cl.
*E21B 34/06* (2006.01)
*E21B 34/08* (2006.01)
(Continued)

(52) U.S. Cl.
CPC ..... *E21B 34/063* (2013.01); *E21B 34/08* (2013.01); *E21B 43/12* (2013.01); *E21B 43/08* (2013.01)

(58) Field of Classification Search
CPC ..... E21B 34/063; E21B 34/08; E21B 34/10; E21B 43/08; E21B 43/12; E21B 21/103
See application file for complete search history.

(56) References Cited

U.S. PATENT DOCUMENTS 4,360,064 A * 11/1982 O'Connor, III ..... E21B 34/10 166/319
8,448,659 B2 * 5/2013 Veit ..... F16K 27/0209 137/111
(Continued)

FOREIGN PATENT DOCUMENTS

WO WO 2012/091829 A2 7/2012

OTHER PUBLICATIONS

International Search Report and The Written Opinion of the International Search Authority, or the Declaration, dated Jan. 16, 2018, PCT/US2016/028088, 9 pages, ISA/KR.

*Primary Examiner* — Christopher J Sebesta
(74) *Attorney, Agent, or Firm* — Haynes and Boone, LLP

(57) ABSTRACT

A pressure actuated inflow control device that includes: a housing having a wall within which a fluid passageway axially extends; a collapsible apparatus coupled to the housing and configured to change from an extended to a retracted configuration when subjected to a predetermined pressure; and an axially extending plug at least partially disposed within the fluid passageway and removable from the fluid passageway; wherein, when the collapsible apparatus is in the extended configuration, the plug is disposed within the fluid passageway at a first position relative to the housing to restrict fluid flow through the fluid passageway; and wherein, when the collapsible apparatus changes to the retracted configuration, the plug is either: moved to a second position relative to the housing to allow fluid flow through the fluid passageway; or capable of moving from the first position to allow fluid flow through the fluid passageway.

18 Claims, 8 Drawing Sheets

(51) Int. Cl.
*E21B 43/12* (2006.01)
*E21B 43/08* (2006.01)

(56) References Cited

U.S. PATENT DOCUMENTS

| | | | | |
|---|---|---|---|---|
| 2006/0118296 | A1 | 6/2006 | Dybevik et al. | |
| 2006/0131033 | A1 | 6/2006 | Bode et al. | |
| 2012/0145404 | A1* | 6/2012 | Schultz | E21B 43/123 166/330 |
| 2013/0180724 | A1 | 7/2013 | Nguyen | |
| 2013/0277059 | A1* | 10/2013 | Holderman | E21B 34/08 166/319 |
| 2015/0060084 | A1 | 3/2015 | Moen et al. | |
| 2015/0083434 | A1* | 3/2015 | Wind | E21B 34/08 166/373 |
| 2018/0142530 | A1* | 5/2018 | Bane | E21B 23/06 |

* cited by examiner

PRESSURE ACTUATED INFLOW CONTROL DEVICE

PRIORITY

The present application is a U.S. National Stage patent application of International Patent Application No. PCT/US2017/028088, filed on Apr. 18, 2017, the benefit of which is claimed and the disclosure of which is incorporated herein by reference in its entirety.

TECHNICAL FIELD

The present disclosure relates generally to an inflow control device of a flow regulating system that is run downhole, and more specifically, to a pressure actuated inflow control device.

BACKGROUND

In the process of completing an oil or gas well, a tubular is run downhole and used to communicate produced hydrocarbon fluids from the formation to the surface. Typically, this tubular is coupled to a flow regulating system that has a screen assembly that controls and limits debris, such as gravel, sand, and other particulate matter, from entering the tubular as the fluid passes through the screen assembly and an inflow control device that controls the flow of the fluid into the tubular. Differences in influx from the reservoir can result in premature water or gas breakthrough, leaving valuable reserves in the ground. Inflow Control Devices (ICDs) are designed to improve completion performance and efficiency by balancing inflow throughout the length of a completion. The inflow control device may have dissolvable plugs extending within fluid passageways to prevent fluid from entering the tubular while the flow regulating system is being positioned downhole, and provide wash-down capability at the same time. Once positioned downhole, the dissolvable plugs are dissolved to allow fluid to flow through the fluid passageways and into the tubular. The method of using dissolvable plugs in the inflow control device may not always be the most cost effective and reliable method of transitioning an inflow control device from a "closed" position to an "open" position.

The present disclosure is directed to a pressure actuated inflow control device.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure are described below as they might be employed in a pressure actuated inflow control device. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

Figure 1:
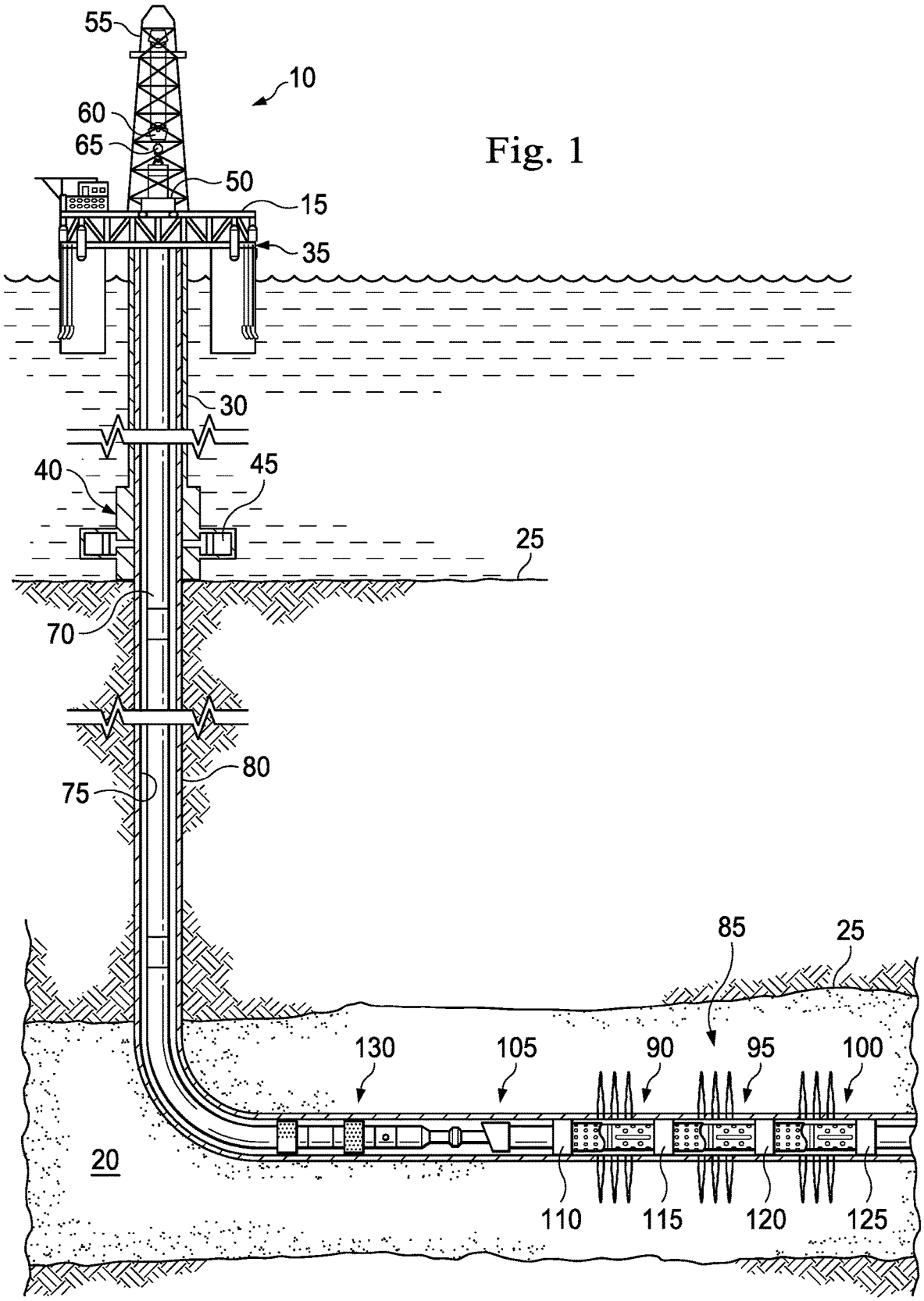
FIG. 1 is a schematic illustration of an offshore oil and gas platform operably coupled to a flow regulating system according to an embodiment of the present disclosure.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) are installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing string 70.

A wellbore 75 extends through the various earth strata including the formation 20 and has a casing string 80 cemented therein. Disposed in a substantially horizontal portion of the wellbore 75 is a lower completion assembly 85 that includes at least one flow regulating system, such as flow regulating system 90 or flow regulating system 95 or 100, and may include various other components, such as a latch subassembly 105, a packer 110, a packer 115, a packer 120, and a packer 125.

Disposed in the wellbore 75 at a lower end of the tubing string 70 is an upper completion assembly 130 that couples to the latch subassembly 105 to place the upper completion assembly 130 and the tubing string 70 in communication with the lower completion assembly 85. In some embodiments, the latch subassembly 105 is omitted.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
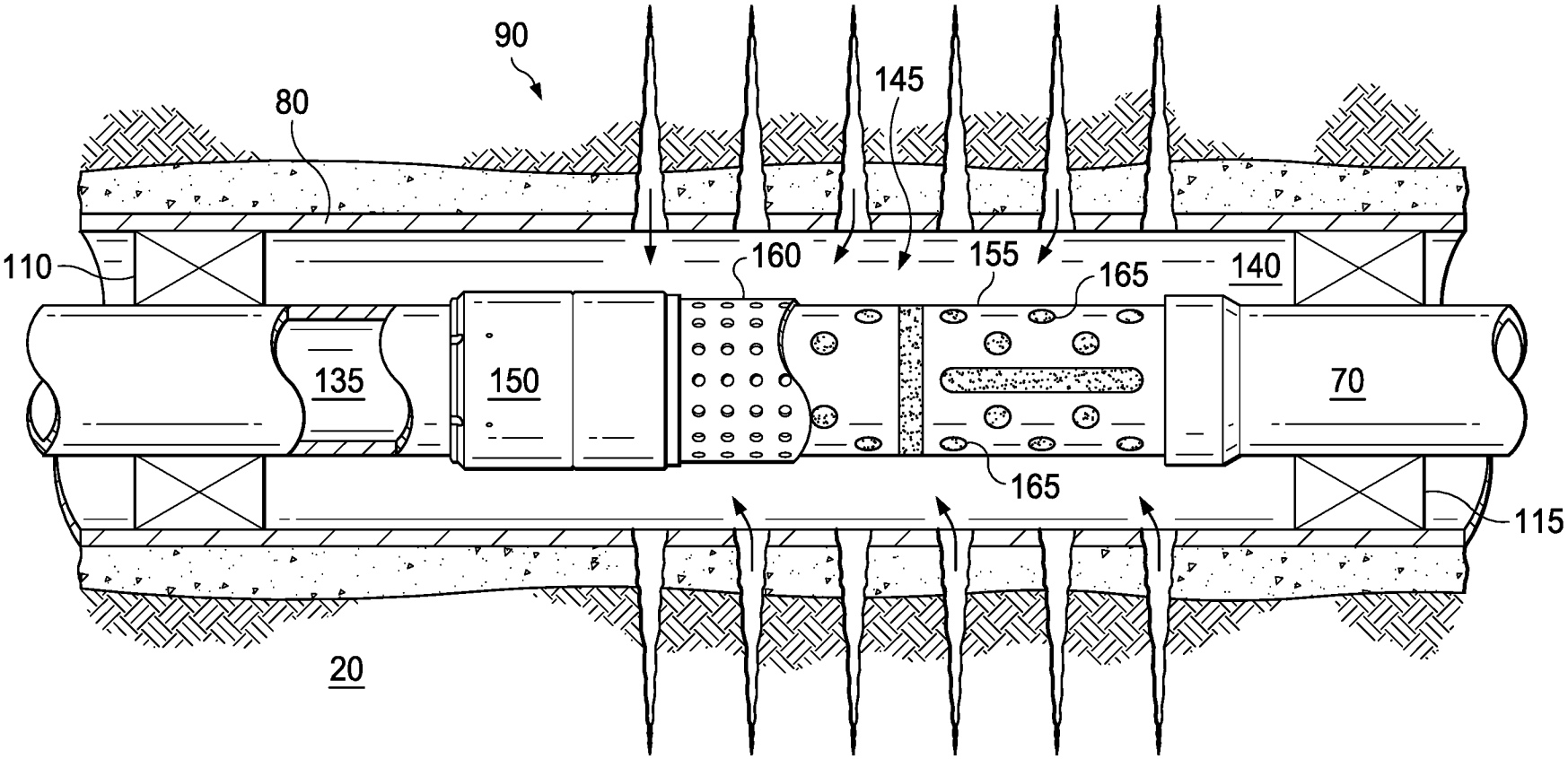
FIG. 2 illustrates a cut-out, side view of the flow regulating system of FIG. 1, according to an exemplary embodiment of the present disclosure.

FIG. 2 illustrates the flow regulating system 90 according to an exemplary embodiment. The flow regulating system 90 regulates flow of a fluid from the formation 20 to an interior flow passage 135 of the tubing string 70 (such as a production tubing string, liner string, etc.). As shown, an annulus 140 is formed radially between the tubing string 70 and the casing string 80. However, the annulus 140 may be formed radially between the tubing string 70 and the formation 20 when the casing string 80 is omitted in open hole completions. The fluid flows from the formation 20 into the interior flow passage 135 through the flow regulating system 90. The flow regulating system 90 generally includes a screen assembly 145 and an inflow control device ("ICD") 150. The screen assembly 145 prevents or at least reduces the amount of debris, such as gravel, sand, fines, and other particulate matter, from entering the interior flow passage 135. In one or more embodiments, the fluid passes through the screen assembly 145 then flows through the ICD 150 and into the interior flow passage 135 for eventual production to the surface. However, the ICD 150 may be used in a wide variety of assemblies, such as for example an assembly that is installed or used in an injector well. The screen assembly 145 may include an elongated tubular screen member 155 and a shroud 160 concentrically disposed about the elongated tubular screen member 155. The elongated tubular screen member 155 may include one or more screens 165. However, in other embodiments, the one or more screens 165 and/or the screen member 155 may be omitted from the ICD 150.

Figure 3:
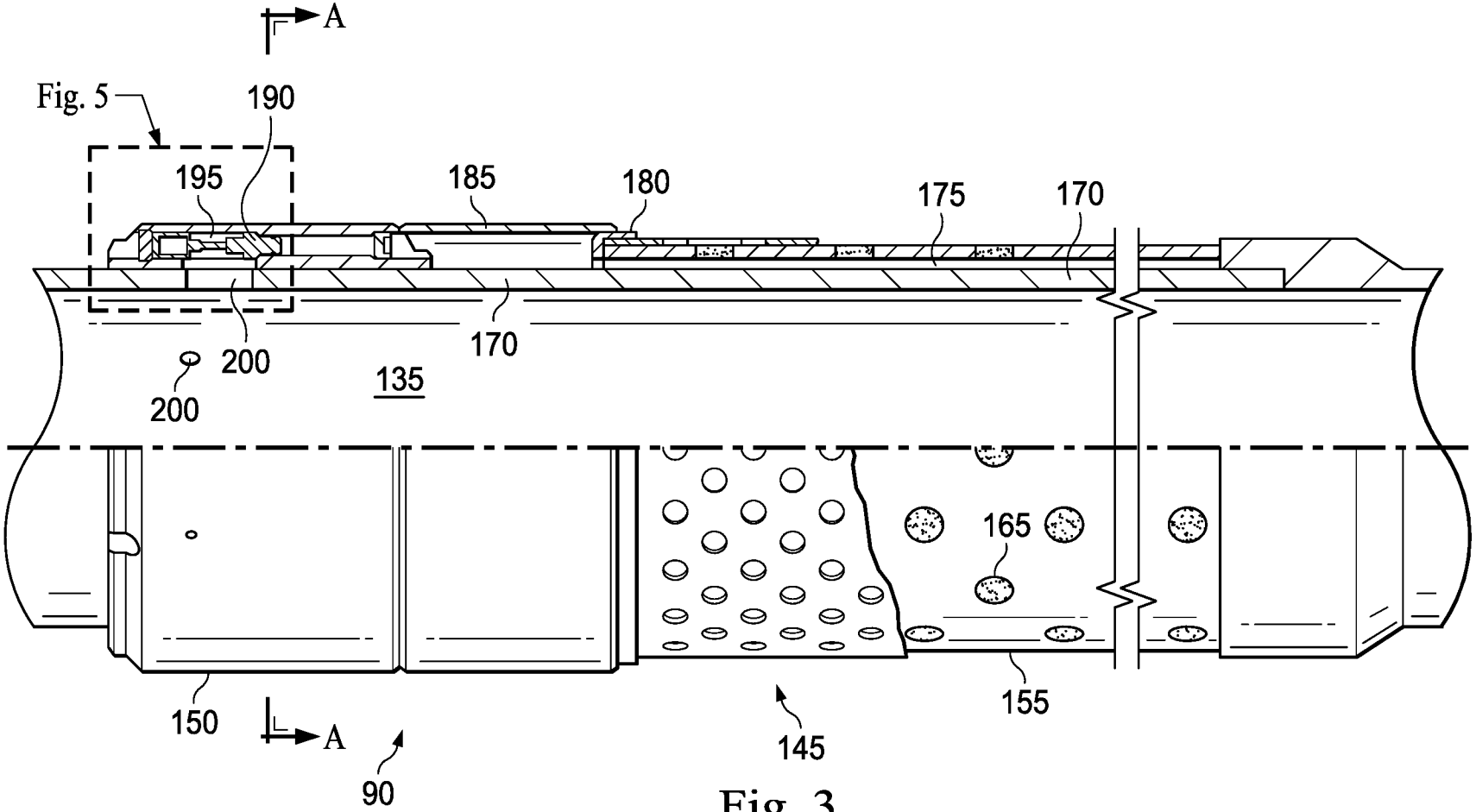
FIG. 3 illustrates a partial sectional view of the flow regulating system of FIG. 2, according to an exemplary embodiment of the present disclosure, the flow regulating system including an inflow control device and a base pipe.
Figure 4:
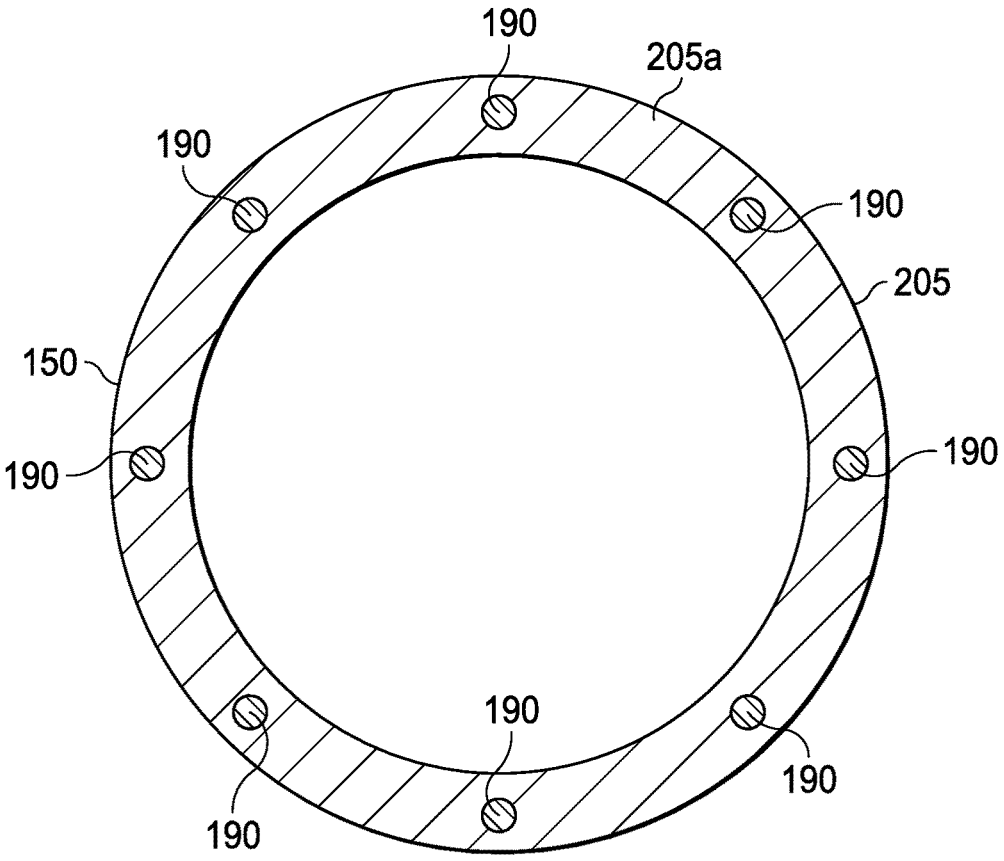
FIG. 4 is a schematic of a cross-sectional view along the line AA of the inflow control device of FIG. 3, according to an exemplary embodiment of the present disclosure.

FIG. 3 illustrates a more detailed view of the flow regulating system 90 according to an exemplary embodiment. In one or more embodiments, the screen assembly 145 of the flow regulating system 90 is the member 155 disposed on an inner tubular member or base pipe 170 so as to define an exterior flow path or passage 175 between the member 155 and the base pipe 170. The passage 175 is formed to direct flow towards the interior flow passage 135. In one or more embodiments, the shroud 160 is disposed about the exterior surface of the member 155 so that at least a portion of the member 155 is covered by the shroud 160. An interface ring 180 is disposed about the exterior surface of the shroud 160 to secure the shroud 160 and the member 155 to the base pipe 170. A sleeve 185 is disposed in proximity to and/or about the exterior surface of the base pipe 170 and defines a portion of the passage 175. In some embodiments, the sleeve 185 is supported by the interface ring 180. The ICD 150 may be disposed adjacent or in proximity to the member 155 along the base pipe 170, preferably concentrically disposed about the exterior surface of the base pipe 170. In an exemplary embodiment, the ICD 150 is configured to be coupled to the sleeve 185. In an exemplary embodiment, the ICD 150 includes one or more plugs 190, each of the plugs 190 restricting the flow of the fluid through a corresponding fluid passageway 195 that axially extends in a longitudinal direction and that is formed in a wall of the ICD 150. Although only one of the plugs 190 is visible in FIG. 3, a series of the plugs 190 may be arranged in parallel, and circumferentially spaced apart within a plurality of fluid passageways 195 formed within the wall of the ICD 150, as depicted in FIG. 4. However, in other embodiments, the plurality of fluid passageways 195 may be arranged in a variety of spacing or arrangements within the wall of the ICD 150 or other downhole tool. Thus, the plurality of fluid passageways that are at least partially formed within the wall provides for parallel flow of the fluid from the passage 175 to the interior flow passage 135 via openings 200 (shown in FIG. 3) in the base pipe 170. In some cases, some of the fluid passageways are permanently plugged to configure the ICD 150 to expected conditions of the reservoir in the formation 20. For example, a portion of the fluid passageways are permanently plugged so that a desired pressure differential between the passage 135 and the annulus 140 is maintained or encouraged. The openings 200 are formed radially through the base pipe 170, which is configured (e.g., with threads at either end, etc.) for interconnection in the tubing string 70.

Figure 5:
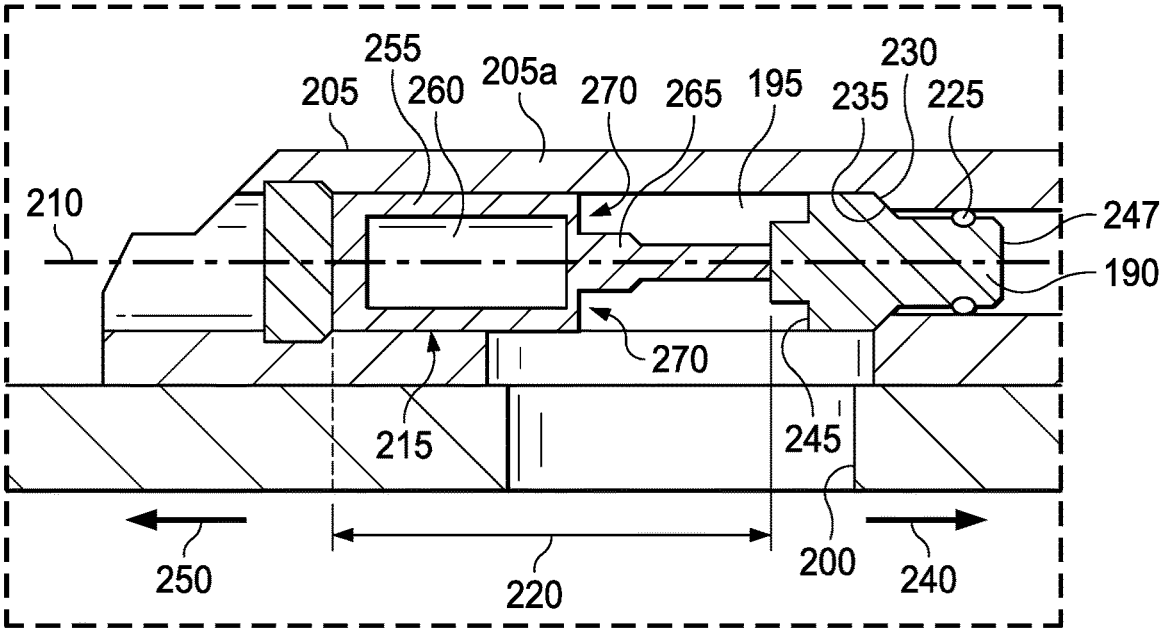
FIG. 5 is a schematic of a portion of the inflow control device of FIG. 3 in an extended configuration, according to an exemplary embodiment of the present disclosure, the portion of the inflow control device comprising a piston and a housing.

FIG. 5 illustrates an enlarged cross-sectional view of a portion of the inflow control device 150. The ICD 150 includes a housing 205 that forms the wall 205*a* within which the first fluid passageway 195 axially extends along a longitudinal axis, which is depicted in FIG. 5 by the reference numeral 210 ("the axis 210"). A first collapsible apparatus 215 is coupled to the housing 205 and configured to change from an extended configuration to a retracted configuration when subjected to a predetermined pressure. The collapsible apparatus 215 may be coupled to the housing using screws, a fiction fit, and the like. However, in other embodiments, portions of the collapsible apparatus 215 may be integrally coupled to the housing 205 such that the housing 205 and portions of the collapsible apparatus 215 are formed from one component. As shown in FIG. 5, the first collapsible apparatus 215 is in the extended configuration and has an axial length 220 measured along the axis 210. The plug 190 is at least partially disposed within the first fluid passageway 195 and operably removable from the fluid passageway 195. When the first collapsible apparatus 215 is in the extended configuration, the first axially extending plug 190 is disposed within the first fluid passageway at 195 a first position relative to the housing to restrict fluid flow through the first fluid passageway 195. One or more seals 225, such as an o-ring, may extend between the plug 190 and an inside surface of the housing 205. The plug forms a shoulder 230 that engages a corresponding shoulder 235 formed in the housing 205 to limit movement of the plug 190 in the direction depicted in FIG. 5 by the reference numeral 240. As a portion of the passageway 195 is in fluid communication with the passage 135, a face 245 of the plug 190 is exposed to fluid that flows from the passage 135 when the plug 190 is in the first position. As another portion of the passageway 195 is in fluid communication with the passage 175, a face 247 is exposed to fluid that flows from the passage 175 (from either the annulus 140 and/or the formation 20). The plug 190 is retained from moving in a direction depicted in FIG. 5 by the reference numeral 250 by the collapsible assembly 215 when the collapsible assembly 215 is in the extended configuration. The plug 190 is retained from moving in the direction 240 by the shoulder 230 that engages the shoulder 235 of the housing 205. The collapsible apparatus 215 generally includes a housing 255 forming a chamber 260 and a piston 265 that is sized to be received in the chamber 260. When the collapsible apparatus 215 is in the extended configuration, the piston 265 is coupled to the housing 255 such that the chamber 260 is fluidically isolated. The chamber 260 may be an atmospheric chamber, a controlled pressure enclosed chamber, or the like. In some embodiments, the collapsible apparatus 215 is at least partially manufactured using an additive manufacturing process. When the first collapsible apparatus 215 is manufactured using an additive manufacturing process, and when the apparatus 215 is in the extended configuration, the piston 26 and the housing 255 are integrally formed as a seamless unit. A portion 270 of the seamless unit that corresponds to the piston 265 is configured to shear relative to the remainder of the seamless unit at the predetermined pressure. The collapsible apparatus 215 may be formed from any variety of materials including metals, polymers, and ceramics.

When in the extended configuration, an applied pressure (or merely a hydrostatic pressure) within the passage 135 provides a force on the apparatus 215 in the direction 250 and a force on the plug 190 via the face 245 in the direction 240. When in the extended configuration, a pressure associated with the formation 20 and/or a fluid pressure within the annulus 140 provides a force on the plug 190 via the face 247 in the direction 250.

Figure 6:
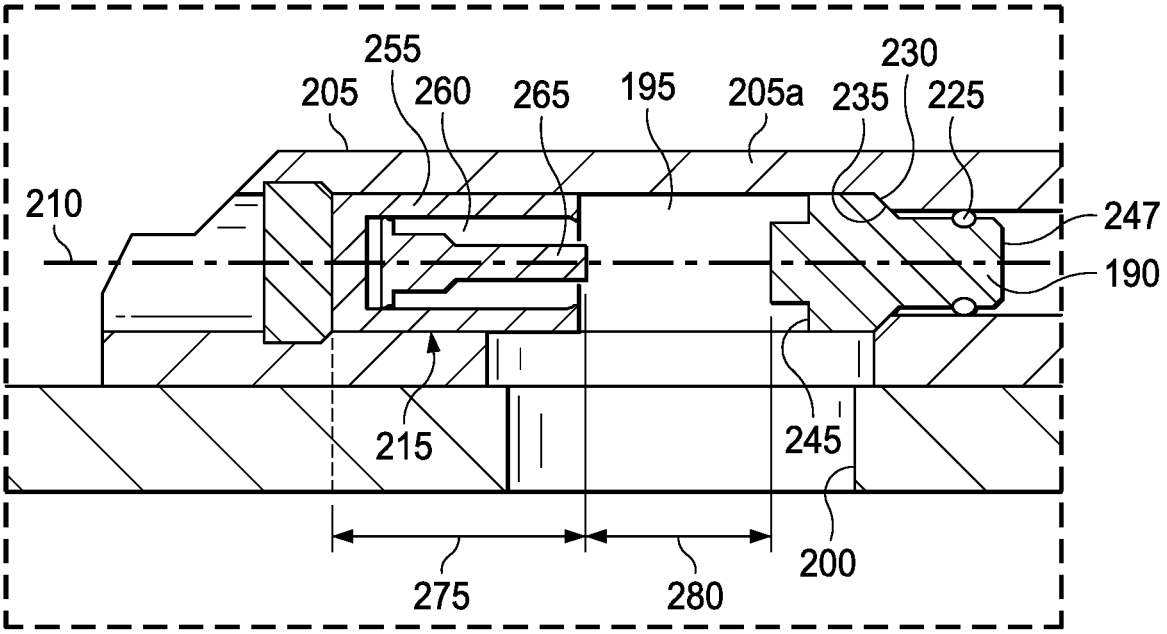
FIG. 6 is a schematic of the portion of the inflow control device of FIG. 5 in a retracted configuration, according to an exemplary embodiment of the present disclosure.

FIG. 6 illustrates an enlarged cross-sectional view of a portion of the inflow control device 150 when the collapsible apparatus 215 is in the retracted configuration and the plug 190 is capable of moving from the first position to allow fluid flow through the first fluid passageway 195. As shown in FIG. 6, the piston 265 is received in the chamber 260 of the housing 255 such that the collapsible apparatus 215 has an axial length 275 measured along the axis 210 that is less than the length 220. When the collapsible apparatus 215 is in the retracted configuration, the piston 265 is spaced from the first axially extending plug 190 by a distance 280 along the axis 210 to allow the first axially extending plug 190 to move from the first position relative to the housing 205. For the collapsible apparatus 215, the piston 265 is a device that maintains the plug 190 in place until a given applied pressure is exceeded, causing a portion 270 of the collapsible apparatus 215 to shear and collapse in length to release the plug 190.

Figure 7:
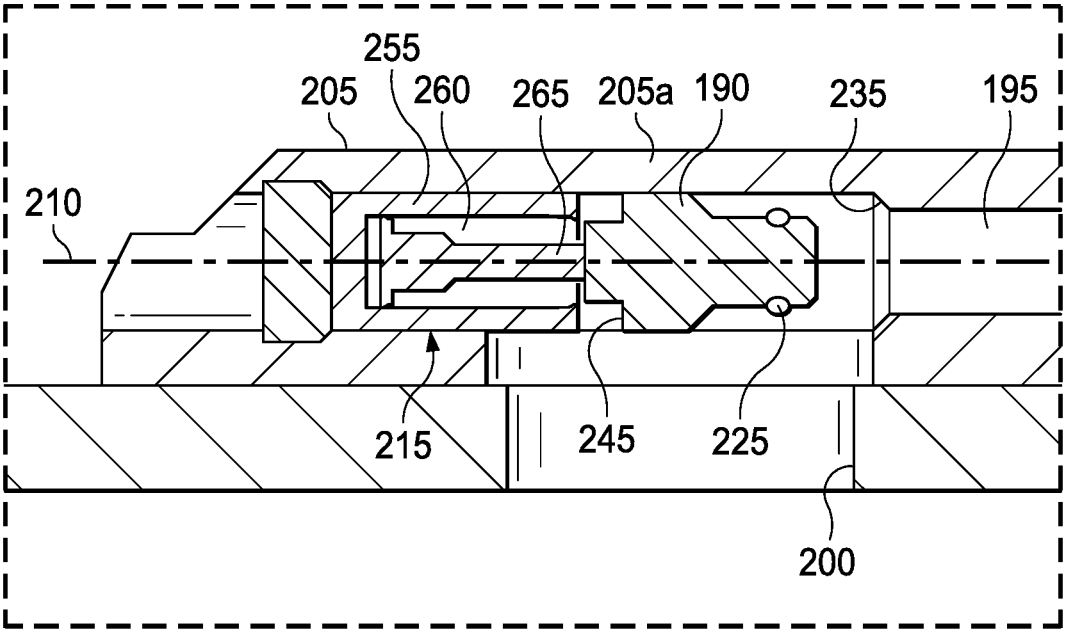
FIG. 7 is a schematic of the portion of the inflow control device of FIG. 5 in a retracted configuration, according to another exemplary embodiment of the present disclosure.

FIG. 7 illustrates an enlarged cross-sectional view of a portion of the inflow control device 150 when the collapsible apparatus 215 is in the retracted configuration and the plug 190 is moved to a second position relative to the housing 205 to allow fluid flow through the first fluid passageway 195. When the collapsible apparatus 215 is in the retracted configuration, the piston 265 remains coupled to the first axially extending plug 190 to move, or pull, the first axially extending plug 190 to the second position relative to the housing 205. Thus, the piston 265 is rigidly coupled to the plug 190.

Figure 8:
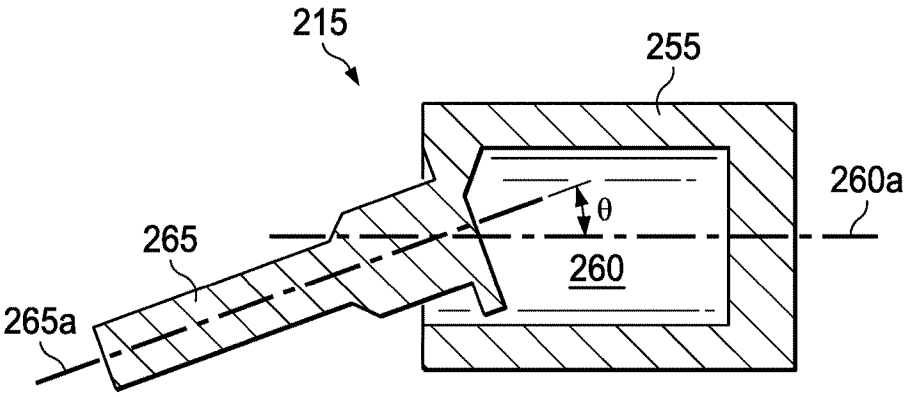
FIG. 8 is a schematic of the piston and housing of FIG. 5, according to another exemplary embodiment of the present disclosure.

FIG. 8 is illustrates another embodiment of the collapsible apparatus 215. The shape—externally or internally—of the collapsible apparatus 215 may be changed to alter or tailor the way in which the apparatus 215 actuates. The collapsible apparatus 215 as shown in FIG. 8 depicts a collapsible apparatus 215 having a piston 265 that has a longitudinal axis **265*a* that is angled relative to the longitudinal axis 260*a* of the chamber 260, unlike the collapsible apparatus 215 of FIGS. 5-7 in which the longitudinal axis of the piston 265 is coaxial with the longitudinal axis of the chamber 260**.

Figure 9:
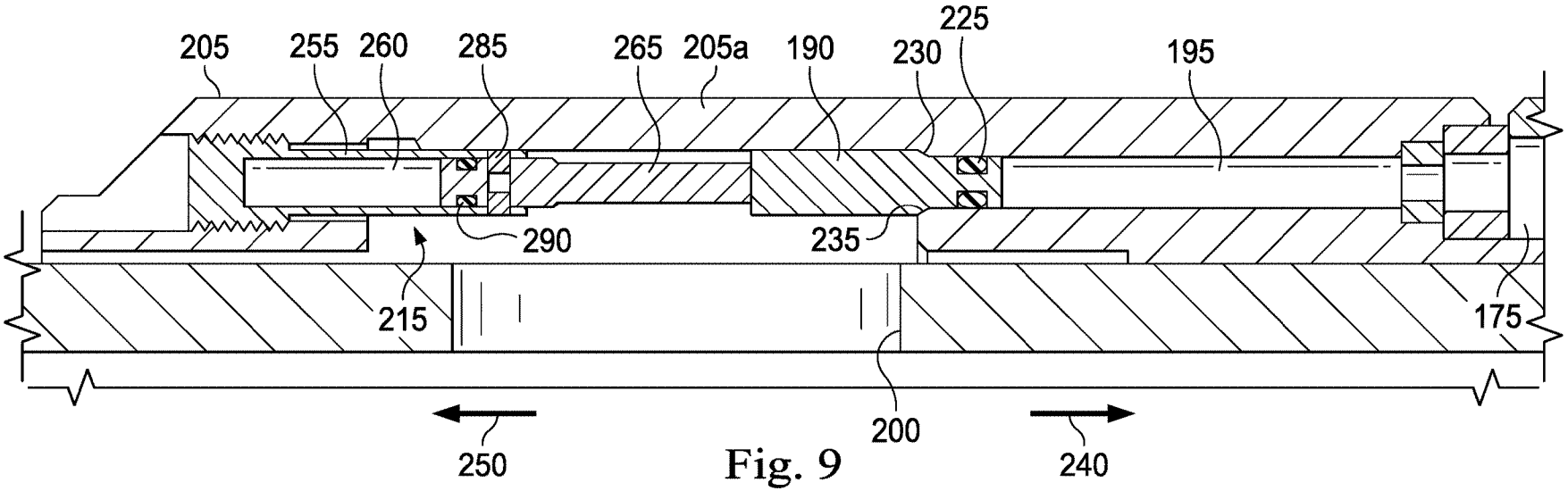
FIG. 9 is a schematic of the portion of the inflow control device of FIG. 3, according to another exemplary embodiment of the present disclosure.

FIG. 9 illustrates another embodiment of the collapsible apparatus 215 that includes a shearable element 285 that couples the piston 265 to the housing 255, with the shearable element 285 being configured to actuate, or shear, at the predetermined pressure. The collapsible apparatus 215 also includes a seal 290 that fluidically isolates the chamber 260 from the passageway 195 when the collapsible apparatus 215 is in the extended configuration. An alternative method to manufacture the collapsible apparatus 215 uses traditional manufacturing methods and the seal 290 and the shearable element 285. The shear element 285 holds the piston 265 in place relative to the housing 255 and the seal 290 is placed between the two parts to create the atmospheric chamber 260. The shearable element 285, such as a shear pin, is configured to shear or actuate at the predetermined pressure. When the predetermined pressure is reached the shearable element 285 is sheared and the piston 265 is able to move into the housing 255 and chamber 260 due to pressure applied to the piston in the direction 250. Once this collapsible apparatus 215 collapses, the plug 190 is no longer supported and can become unseated from the shoulder 235 of the housing 205 and allow fluid to flow through the ICD 150. The seals 225 and/or the seals 290 may be an o-ring, plastic, or metal seal. Alternatively the piston 265 and plug 190 could be combined into a single part or mechanically coupled. This would cause the piston 265 to pull the plug 190 away from the shoulder 235. The coupling could be rigid or allow relative movement between the components.

Figure 10:
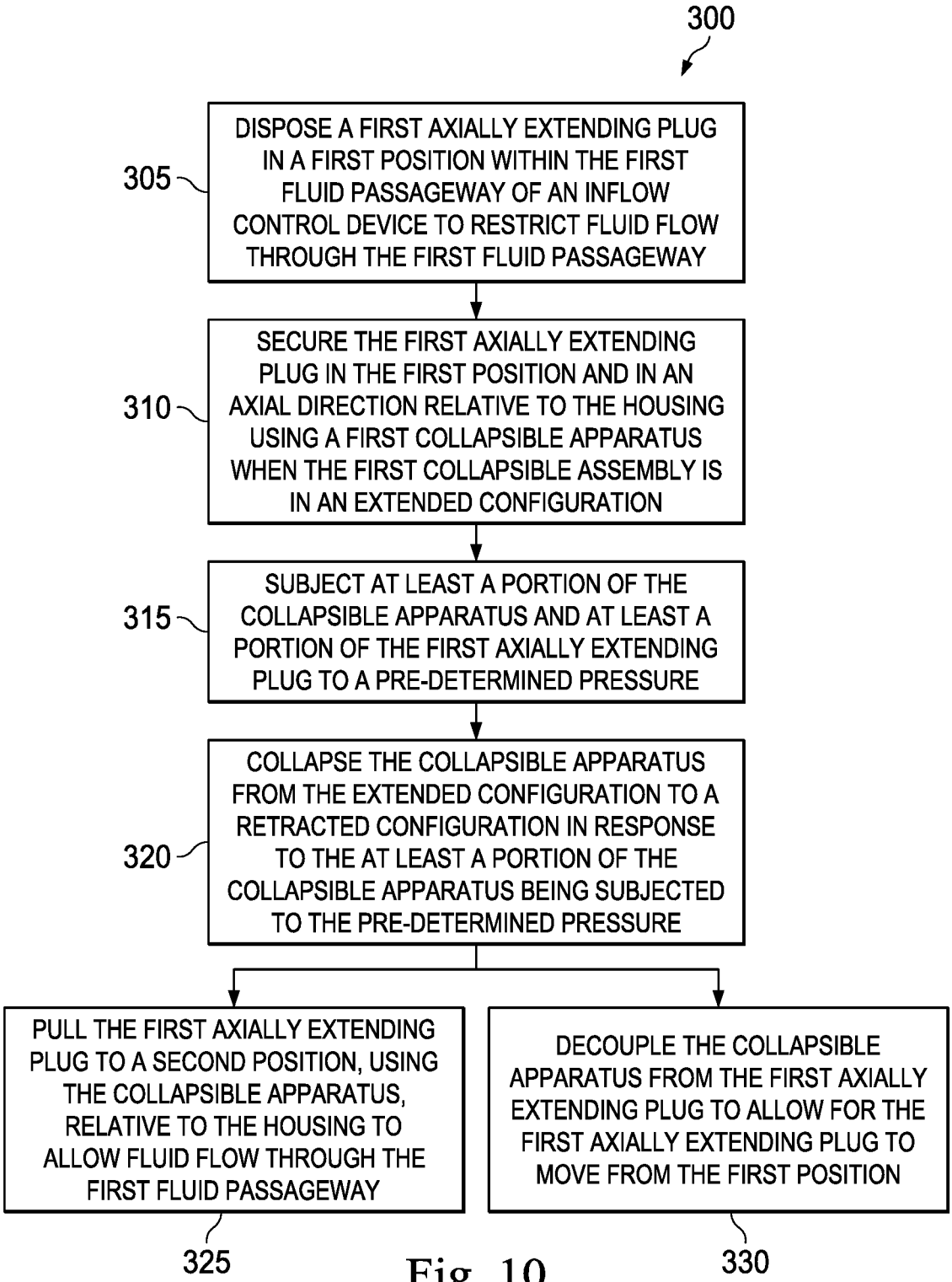
FIG. 10 is a flow chart illustration of a method of operating the apparatus of FIGS. 1-9, according to an exemplary embodiment.

In an exemplary embodiment, as illustrated in FIG. 10 with continuing reference to FIGS. 1-9, a method 300 of operating the inflow control device 150 includes disposing the first axially extending plug 190 in the first position within the first fluid passageway 195 to restrict fluid flow through the first fluid passageway 195 at step 305; securing the first axially extending plug 190 in the first position and in an axial direction relative to the housing 205 using the first collapsible apparatus 215 when the first collapsible apparatus 215 is in an extended configuration at step 310; subjecting at least a portion of the collapsible apparatus 215 and at least a portion of the first axially extending plug 190 to the predetermined pressure at step 315; collapsing the collapsible apparatus 215 from the extended configuration to a retracted configuration in response to the at least a portion of the collapsible apparatus 215 being subjected to the pre-determined pressure at step 320; and either: pulling the first axially extending plug 190 to the second position, using the collapsible apparatus 215, relative to the housing 205 to allow fluid flow through the first fluid passageway 195 at step 325; or decoupling the collapsible apparatus 215 from the first axially extending plug 190 to allow for the first axially extending plug 190 to move from the first position at step 330.

At the step 305, the first axially extending plug 190 is disposed in the first position within the first fluid passageway 195 to restrict fluid flow through the first fluid passageway 195.

At the step 310, the first axially extending plug 190 is secured in the first position and in an axial direction relative to the housing 205 using the first collapsible apparatus 215 when the first collapsible apparatus is in an extended configuration.

At the step 315, at least a portion of the collapsible apparatus 215 and at least a portion of the first axially extending plug 190 is subjected to the predetermined pressure. The predetermined pressure is one of the applied pressure within the passage 135, the pressure of the formation 20 and/or the pressure of the fluid within the annulus 140, and a hydrostatic pressure within the passage 135 or the annulus 140.

At the step 320, the collapsible apparatus 215 collapses, or changes, from the extended configuration to the retracted configuration in response to the at least a portion of the collapsible apparatus 215 being subjected to the predetermined pressure. Thus, the inflow control device 150 is a pressure actuated inflow control device. When the shearable element 285 couples the piston 265 to the housing 255, collapsing the collapsible apparatus 215 includes shearing the shearable element 285 to allow for of the piston 265 to move relative to the housing 255. When the collapsible apparatus 215 is a seamless unit in the extended configuration, collapsing the collapsible apparatus 215 includes shearing the portion 270 of the seamless unit corresponding to the piston 265 relative to the remainder of the seamless unit such that the piston 265 is received within the chamber 260 of the housing 255.

At the step 325, the first axially extending plug 190 is pulled to the second position as shown in FIG. 7, using the collapsible apparatus 215, relative to the housing 205 to allow fluid flow through the first fluid passageway 195. In this embodiment, the piston 265 is rigidly coupled to the plug 190 to move the plug 190 upon actuation of the collapsible apparatus 215.

At the step 330, the collapsible apparatus 215 is decoupled from the first axially extending plug 190 to allow for the first axially extending plug 190 to move from the first position. At the step 330 and as shown in FIG. 6, the first axially extending plug 190 remains disposed in the first axially extending fluid passageway 195 at the first position after the collapsible apparatus 215 changes to the retracted configuration, which allows for the pressure within the passage 135 to be maintaining or at least not reduced to the flow of the fluid out of the passage 135 and into the annulus 140 via the fluid passageway 195.

When the method includes the step 330, the method 300 may also include reducing the applied pressure within the passage 135 below the predetermined pressure to move the first axially extending plug 190 from the first position. When the pressure in the passage 135 is reduced, the reservoir pressure or the pressure within the annulus 140 pushes the plug 190 in the direction 250, from the first position, and into the passage 135.

The method 300 may also include disposing a second axially extending plug that is identical or substantially identical to the plug 190 in a position that is identical or substantially identical to the first position of the plug 190 within a second fluid passageway that is identical or substantially identical to the passageway 195 to restrict fluid flow through the second fluid passageway; securing the second axially extending plug in the third position and in the axial direction relative to the housing using a second collapsible apparatus when the second collapsible apparatus is in an extended configuration; subjecting at least a portion of the second collapsible apparatus and at least a portion of the second axially extending plug to the pre-determined pressure; collapsing the second collapsible apparatus from the extended configuration to the retracted configuration in response to the at least a portion of the second collapsible apparatus being subjected to the predetermined pressure; and decoupling the second collapsible apparatus from the second axially extending plug to allow for the second axially extending plug to move from the third position. That is, the method 300 may apply to a plurality of plugs 190. When the collapsible apparatus 215 is configured to decouple from the plugs 190 when moving to the retracted configuration upon being subjected to the predetermined pressure, the plug 190 is allowed to remain in the passageway 195 and may be secured against the shoulder 235 in the direction 240 due to the force exerted on a face 245 of the plug 190 the fluid pressure in the passage 135. As such, even after one or two of the collapsible apparatuses 215 have already actuated, the fluid flow through the passageways 195 is still restricted, which allows for pressure to remain at the predetermined pressure or increase above the predetermined pressure to actuate any collapsible apparatuses 215 that remain in the extended configuration.

Exemplary embodiments of the present disclosure may be altered in a variety of ways. For example, the collapsible apparatus 215 may be used in combination with the plug 190 or other types of devices that alternate between first and second positions, with the collapsible apparatus 215 being used to secure the device in a first position and either pull the device to a second position or merely allow the device to move from the first position when the collapsible apparatus 215 is changed from the extended configuration to the retracted configuration. The plug 190 or device used in conjunction with the collapsible apparatus 215 may be tailored depending on the functionality and pressure rating requirements. The collapsible assembly 215 and/or the plug 190 may be any size and shape. The fluid passageway 195 may extend through the wall of the ICD 150 not only in a direction that is parallel to the axis 210, but in any direction that may or may not be angled relative to the axis 210. The plug 190 extends along the longitudinal axis of the passageway 195 and may also extend in any direction that may or may not be angled relative to the axis 210. For example, the fluid passageway 175 may be formed radially through the housing 205. Moreover, the fluid passageway 195 may be at least partially formed through the base pipe 170 or be formed using the base pipe 170 and the housing 205 of the ICD 150. The collapsible assembly 215, with or without the plug 190, may be used in any variety of downhole tools and is not limited to inflow control devices that form a portion of a flow regulating system. Additionally, the collapsible apparatus could include a tube having a first and opposing second end, with a rupture disc welded to one of the first and second ends.

In an alternate exemplary embodiment, it is not necessary for the wellbore 75 to be cased, cemented or horizontal as depicted in FIG. 1. It is also not necessary for the fluid to flow from the formation 20 to the interior flow passage 135, since in injection, conformance, or other operations, fluid can flow in an opposite direction.

In an exemplary embodiment, during the operation of the apparatus 150 and/or the execution of the method 300, 3D printing capabilities are implemented to create devices actuating with pressure (applied pressure, reservoir pressure, and/or absolute hydrostatic pressure) in order to induce a primary or secondary function. Moreover, 3D printing capabilities allow for the manufacture of components with an integrated atmospheric or even controlled pressure enclosed chamber. This, in conjunction with manufacturing with a defined geometry and using material with known mechanical characteristics, facilitates creating a device which functions/activates under a predefined applied pressure, reservoir pressure, and/or absolute hydrostatic pressure. Depending upon the design, a portion of the component shears at a predefined point and changes in external shape/dimension according to the geometry of the device. The result is a method for actuating devices of many shapes and forms and functionality without risk of contamination from its environment and at a very low cost and ease of manufacture. When the apparatus 215 is at least partially manufactured using additive manufacturing, multiple components may be omitted compared to an apparatus that is manufactured using traditional methods. Thus, the construction method of the apparatus 215 when using additive manufacturing not only reduces the number of items comprising the apparatus 215, but also increases the reliability while reducing the potential for malfunction. This provides increased functionality, reliability and reduced cost.

Figure 11:
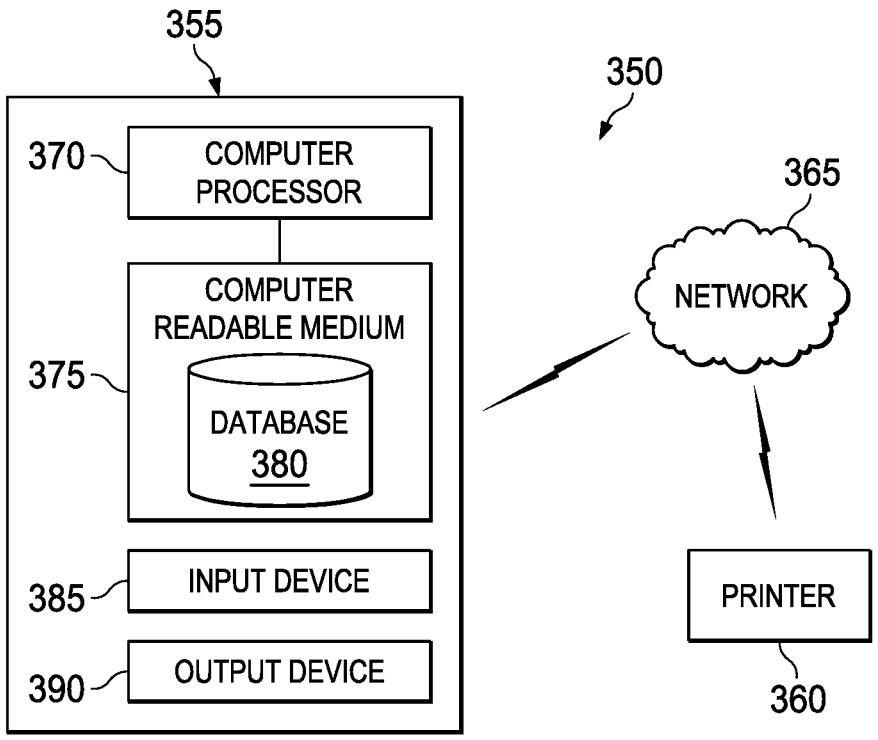
FIG. 11 illustrates an additive manufacturing system, according to an exemplary embodiment.

In an exemplary embodiment and as shown in FIG. 11, a downhole tool printing system 350 includes one or more computers 355 and a printer 360 that are operably coupled together, and in communication via a network 365. In one or more exemplary embodiments, the apparatus 215 may be manufactured using the downhole tool printing system 350. In one or more exemplary embodiments, the one or more computers 355 include a computer processor 370 and a computer readable medium 375 operably coupled thereto. In one or more exemplary embodiments, the computer processor 370 includes one or more processors. Instructions accessible to, and executable by, the computer processor 370 are stored on the computer readable medium 375. A database 380 is also stored in the computer readable medium 375. In one or more exemplary embodiments, the computer 355 also includes an input device 385 and an output device 390. In one or more exemplary embodiments, web browser software is stored in the computer readable medium 375. In one or more exemplary embodiments, three dimensional modeling software is stored in the computer readable medium. In one or more exemplary embodiments, software involving finite element analysis and topology optimization is stored in the computer readable medium 375. In one or more exemplary embodiments, any one or more constraints are entered in the input device 385 such that the software aids in the design on the collapsible assembly 215 in which specific portions of the collapsible assembly 215 are sized to shear at the predetermined pressure. In one or more exemplary embodiments, the input device 385 is a keyboard, mouse, or other device coupled to the computer 355 that sends instructions to the computer 355. In one or more exemplary embodiments, the input device 385 and the output device 390 include a graphical display, which, in several exemplary embodiments, is in the form of, or includes, one or more digital displays, one or more liquid crystal displays, one or more cathode ray tube monitors, and/or any combination thereof. In one or more exemplary embodiments, the output device 390 includes a graphical display, a printer, a plotter, and/or any combination thereof. In one or more exemplary embodiments, the input device 385 is the output device 390, and the output device 390 is the input device 385. In several exemplary embodiments, the computer 355 is a thin client. In several exemplary embodiments, the computer 355 is a thick client. In several exemplary embodiments, the computer 355 functions as both a thin client and a thick client. In several exemplary embodiments, the computer 355 is, or includes, a telephone, a personal computer, a personal digital assistant, a cellular telephone, other types of telecommunications devices, other types of computing devices, and/or any combination thereof. In one or more exemplary embodiments, the computer 355 is capable of running or executing an application. In one or more exemplary embodiments, the application is an application server, which in several exemplary embodiments includes and/or executes one or more web-based programs, Intranet-based programs, and/or any combination thereof. In one or more exemplary embodiments, the application includes a computer program including a plurality of instructions, data, and/or any combination thereof. In one or more exemplary embodiments, the application written in, for example, HyperText Markup Language (HTML), Cascading Style Sheets (CSS), JavaScript, Extensible Markup Language (XML), asynchronous JavaScript and XML (Ajax), and/or any combination thereof.

In one or more exemplary embodiments, the printer 360 is a three-dimensional printer. In one or more exemplary embodiments, the printer 360 includes a layer deposition mechanism for depositing material in successive adjacent layers; and a bonding mechanism for selectively bonding one or more materials deposited in each layer. In one or more exemplary embodiments, the printer 360 is arranged to form a unitary printed body by depositing and selectively bonding a plurality of layers of material one on top of the other. In one or more exemplary embodiments, the printer 360 is arranged to deposit and selectively bond two or more different materials in each layer, and wherein the bonding mechanism includes a first device for bonding a first material in each layer and a second device, different from the first device, for bonding a second material in each layer. In one or more exemplary embodiments, the first device is an ink jet printer for selectively applying a solvent, activator or adhesive onto a deposited layer of material. In one or more exemplary embodiments, the second device is a laser for selectively sintering material in a deposited layer of material. In one or more exemplary embodiments, the layer deposition means includes a device for selectively depositing at least the first and second materials in each layer. In one or more exemplary embodiments, any one of the two or more different materials may be Acrylonitrile-Butadiene-Styrene or ABS plastic, Polylactic acid or PLA, polyamide, aluminum, glass filled polyamide, sterolithography materials, silver, titanium, steel, wax, photopolymers, polycarbonate, and a variety of other materials. In one or more exemplary embodiments, the printer 360 may involve directed energy deposition using powder or wire, fused deposition modeling, selective laser sintering, and/or multi-jet modeling. In operation, the computer processor 370 executes a plurality of instructions stored on the computer readable medium 375. As a result, the computer 355 communicates with the printer 360, causing the printer 360 to manufacture the apparatus 215 or at least a portion thereof. In one or more exemplary embodiments, manufacturing the collapsible assembly 215 using the system 350 results in an integrally formed collapsible assembly 215 that is a seamless unit.

Figure 12:
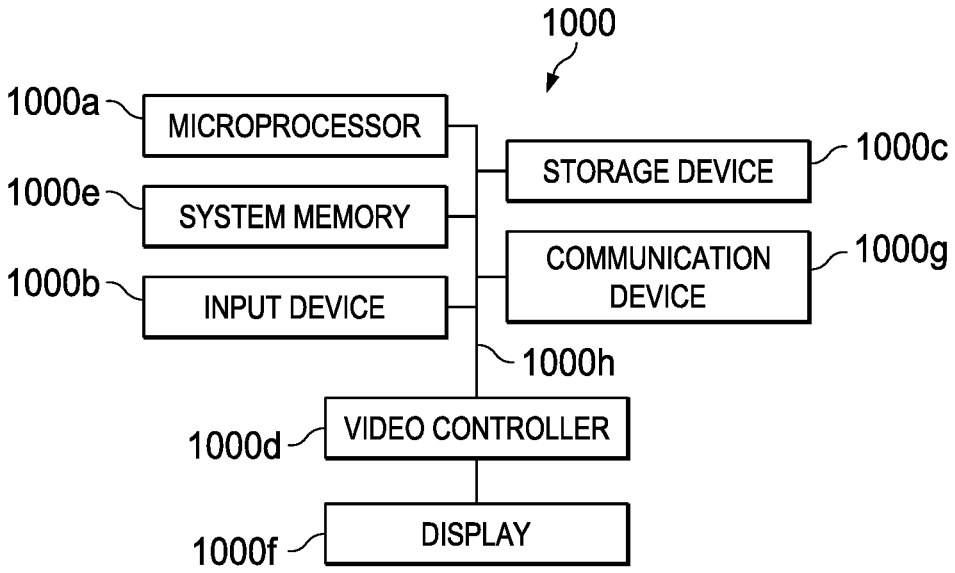
FIG. 12 is a diagrammatic illustration of a node for implementing one or more exemplary embodiments of the present disclosure, according to an exemplary embodiment.

In one or more exemplary embodiments, as illustrated in FIG. 12 with continuing reference to FIGS. 1-11, an illustrative computing device 1000 for implementing one or more embodiments of one or more of the above-described networks, elements, methods and/or steps, and/or any combination thereof, is depicted. The computing device 1000 includes a processor 1000*a*, an input device 1000*b*, a storage device 1000*c*, a video controller 1000*d*, a system memory 1000*e*, a display 1000*f*, and a communication device 1000*g*, all of which are interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer readable medium that may contain executable instructions. In one or more exemplary embodiments, the computer readable medium is a non-transitory tangible media. In several exemplary embodiments, the communication device 1000*g* may include a modem, network card, or any other device to enable the computing device 1000 to communicate with other computing devices. In several exemplary embodiments, any computing device represents a plurality of interconnected (whether by intranet or Internet) computer systems, including without limitation, personal computers, mainframes, personal digital assistants ("PDAs"), smartphones and cell phones.

In several exemplary embodiments, the one or more computers 355, the printer 360, and/or one or more components thereof, are, or at least include, the computing device 1000 and/or components thereof, and/or one or more computing devices that are substantially similar to the computing device 1000 and/or components thereof. In several exemplary embodiments, one or more of the above-described components of one or more of the computing device 1000, one or more computers 355, and the printer 360 and/or one or more components thereof, include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In one or more exemplary embodiments, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In one or more exemplary embodiments, a data structure may provide an organization of data, or an organization of executable code.

In several exemplary embodiments, the network 365, and/or one or more portions thereof, may be designed to work on any specific architecture. In one or more exemplary embodiments, one or more portions of the network 365 may be executed on a single computer, local area networks, client-server networks, wide area networks, internets, hand-held and other portable and wireless devices and networks.

In several exemplary embodiments, a database may be any standard or proprietary database software, such as Oracle, Microsoft Access, SyBase, or DBase II, for example. In several exemplary embodiments, the database may have fields, records, data, and other database elements that may be associated through database specific software. In several exemplary embodiments, data may be mapped. In several exemplary embodiments, mapping is the process of associating one data entry with another data entry. In one or more exemplary embodiments, the data contained in the location of a character file can be mapped to a field in a second table. In several exemplary embodiments, the physical location of the database is not limiting, and the database may be distributed. In one or more exemplary embodiments, the database may exist remotely from the server, and run on a separate platform. In one or more exemplary embodiments, the database may be accessible across the Internet. In several exemplary embodiments, more than one database may be implemented.

In several exemplary embodiments, a computer program, such as a plurality of instructions stored on a computer readable medium, such as the computer readable medium 375, the system memory 1000*e*, and/or any combination thereof, may be executed by a processor to cause the processor to carry out or implement in whole or in part the operation of the system 350, and/or any combination thereof. In several exemplary embodiments, such a processor may include one or more of the computer processor 370, the processor 1000*a*, and/or any combination thereof. In several exemplary embodiments, such a processor may execute the plurality of instructions in connection with a virtual computer system.

In several exemplary embodiments, a plurality of instructions stored on a computer readable medium may be executed by one or more processors to cause the one or more processors to carry out or implement in whole or in part the above-described operation of each of the above-described exemplary embodiments of the system, the method, and/or any combination thereof. In several exemplary embodiments, such a processor may include one or more of the microprocessor 1000*a*, any processor(s) that are part of the components of the system, and/or any combination thereof, and such a computer readable medium may be distributed among one or more components of the system. In several exemplary embodiments, such a processor may execute the plurality of instructions in connection with a virtual computer system. In several exemplary embodiments, such a plurality of instructions may communicate directly with the one or more processors, and/or may interact with one or more operating systems, middleware, firmware, other applications, and/or any combination thereof, to cause the one or more processors to execute the instructions.

During operation of the system 350, the computer processor 370 executes the plurality of instructions that causes the manufacture of the collapsible assembly 215 using additive manufacturing. Thus, the collapsible assembly 215 is at least partially manufactured using an additive manufacturing process. Manufacturing the collapsible assembly 215 via machining forged billet stock or using multi-axis milling processes often limits the geometries and design of the collapsible assembly 215. Thus, with additive manufacturing, complex geometries—such as the chamber 260 or a plurality of chambers—are achieved or allowed, which results in the creation of one type of pressure actuated inflow control device.

In an exemplary embodiment, the collapsible assembly 215 is a metal tubular member although the collapsible assembly 215 may be composed of a non-metal material, such as a plastic or composite material.

Thus, a pressure actuated inflow control device has been described. Embodiments of the pressure actuated inflow control device may generally include a housing having a wall within which a fluid passageway axially extends; a collapsible apparatus coupled to the housing and configured to change from an extended configuration to a retracted configuration when subjected to a predetermined pressure; and an axially extending plug at least partially disposed within the fluid passageway and operably removable from the fluid passageway; wherein, when the collapsible apparatus is in the extended configuration, the axially extending plug is disposed within the fluid passageway at a first position relative to the housing to restrict fluid flow through the fluid passageway; and wherein, when the collapsible apparatus changes to the retracted configuration, the axially extending plug is either: moved to a second position relative to the housing to allow fluid flow through the fluid passageway; or capable of moving from the first position to allow fluid flow through the fluid passageway. Any of the foregoing embodiments may include any one of the following elements, alone or in combination with each other:

The collapsible apparatus includes: a housing forming a chamber; and a piston sized to be received in the chamber; wherein, when the collapsible apparatus is in the extended configuration: the piston is coupled to the housing to fluidically isolate the chamber; and the collapsible apparatus has a first axial length; and wherein, when the collapsible apparatus is in the retracted configuration: the piston is received in the housing; and the collapsible apparatus has a second axial length that is less than the first axial length.

A shearable element couples the piston to the housing and wherein the shearable element is configured to actuate at the predetermined pressure.

The collapsible apparatus is at least partially manufactured using an additive manufacturing process.

When the collapsible apparatus is in the extended configuration, the piston and the housing are integrally formed as a seamless unit; and a portion of the seamless unit corresponding to the piston is configured to shear relative to a remainder of the seamless unit at the predetermined pressure.

When the collapsible apparatus is in the extended configuration, the piston is coupled to the axially extending plug to secure the axially extending plug at the first position relative to the housing.

When the collapsible apparatus is in the retracted configuration, the piston is spaced from the axially extending plug to allow the axially extending plug to move from the first position.

When the collapsible apparatus is in the extended configuration, the piston is coupled to the axially extending plug to secure the axially extending plug at the first position relative to the housing.

When the collapsible apparatus is in the retracted configuration, the piston remains coupled to the axially extending plug to move the axially extending plug to the second position relative to the housing.

The inflow control device forms a portion of a tubing string that defines an internal flow path and that is configured to extend within a wellbore extending within a reservoir having a reservoir pressure; and wherein the predetermined pressure is one of a predefined applied pressure within the internal flow path of the tubing string, the reservoir pressure, and a hydrostatic pressure.

Thus, a method of controlling a flow of a fluid through an inflow control device including a housing having a wall within which a first fluid passageway axially and a second fluid passageway extend has been described. Embodiments of the pressure actuated inflow control device may generally include disposing a first axially extending plug in a first position within the first fluid passageway to restrict fluid flow through the first fluid passageway; securing the first axially extending plug in the first position and in an axial direction relative to the housing using a first collapsible apparatus when the first collapsible apparatus is in an extended configuration; subjecting at least a portion of the collapsible apparatus and at least a portion of the first axially extending plug to a predetermined pressure; collapsing the collapsible apparatus from the extended configuration to a retracted configuration in response to the at least a portion of the collapsible apparatus being subjected to the predetermined pressure; and either: moving the first axially extending plug to a second position, using the collapsible apparatus, relative to the housing to allow fluid flow through the first fluid passageway; or decoupling the collapsible apparatus from the first axially extending plug to allow for the first axially extending plug to move from the first position. Any of the foregoing embodiments may include any one of the following elements, alone or in combination with each other:

The first collapsible apparatus includes a housing forming a chamber; and a piston sized to be received in the chamber.

When the first collapsible apparatus is in the extended configuration: the piston is coupled to the housing to fluidically isolate the chamber; and the first collapsible apparatus has a first axial length.

When the first collapsible apparatus is in the retracted configuration: the piston is received in the housing; and the first collapsible apparatus has a second axial length that is less than the first axial length.

A shearable element couples the piston to the housing.

Collapsing the collapsible apparatus from the extended configuration to the retracted configuration in response to the at least the portion of the collapsible apparatus being subjected to the predetermined pressure includes shearing the shearable element.

The first collapsible apparatus is at least partially manufactured using an additive manufacturing process.

When the first collapsible apparatus is in the extended configuration, the piston and the housing are integrally formed as a seamless unit; a portion of the seamless unit corresponding to the piston is configured to shear relative to the portion of the seamless unit corresponding to the housing at the predetermined pressure; and collapsing the collapsible apparatus from the extended configuration to the retracted configuration in response to the at least the portion of the collapsible apparatus being subjected to the predetermined pressure includes shearing the portion of the seamless unit corresponding to the piston relative to a remainder of the seamless unit such that the piston is received within the chamber of the housing.

Decoupling the collapsible apparatus from the first axially extending plug to allow for the first axially extending plug to move from the first position; and when the collapsible apparatus is in the extended configuration, the piston is coupled to the first axially extending plug to secure the first axially extending plug at the first position relative to the housing; and wherein collapsing the collapsible apparatus from the extended configuration to the retracted configuration in response to the at least the portion of the collapsible apparatus being subjected to the predetermined pressure includes decoupling the collapsible apparatus from the first axially extending plug.

When the collapsible apparatus is in the extended configuration, the piston is coupled to the first axially extending plug to secure the first axially extending plug at the first position relative to the housing.

Moving the first axially extending plug to the second position, using the piston of the collapsible apparatus, relative to the housing to allow fluid flow through the first fluid passageway.

The inflow control device forms a portion of a tubing string that defines an internal flow path and that is configured to extend within a wellbore extending within a reservoir having a reservoir pressure; and wherein the predetermined pressure is one of an applied pressure within the internal flow path of the tubing string, the reservoir pressure, and a hydrostatic pressure.

Decoupling the collapsible apparatus from the first axially extending plug to allow for the first axially extending plug to move from the first position; wherein the predetermined pressure is the applied pressure within the internal flow path of the tubing string; and wherein the method further includes reducing the applied pressure within the wellbore below the predefined predetermined pressure to move the first axially extending plug from the first position.

The chamber is one of an atmospheric chamber and a controlled pressure enclosed chamber.

The predetermined pressure is an applied pressure within the internal flow path of the tubing string; and wherein the first axially extending plug remains disposed in the first axially extending fluid passageway at the first position after changing the collapsible apparatus to the retracted configuration thereby maintaining the applied pressure within the wellbore at or above the predetermined pressure.

Disposing a second axially extending plug in a third position within the second fluid passageway to restrict fluid flow through the second fluid passageway; securing the second axially extending plug in the third position and in the axial direction relative to the housing using a second collapsible apparatus when the second collapsible apparatus is in an extended configuration; subjecting at least a portion of the second collapsible apparatus and at least a portion of the second axially extending plug to the predetermined pressure; collapsing the second collapsible apparatus from the extended configuration to the retracted configuration in response to the at least a portion of the second collapsible apparatus being subjected to the predetermined pressure; and decoupling the second collapsible apparatus from the second axially extending plug to allow for the second axially extending plug to move from the third position.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

What is claimed is:

1. A pressure actuated inflow control device, the pressure actuated inflow control device comprising:

a housing having a wall within which a fluid passageway axially extends;

a collapsible apparatus coupled to the housing and configured to change from an extended configuration to a retracted configuration when subjected to a predetermined pressure; and an axially extending plug at least partially disposed within the fluid passageway and operably removable from the fluid passageway while positioned in a wellbore;

wherein, when the collapsible apparatus is in the extended configuration, the axially extending plug is disposed within the fluid passageway at a first position relative to the housing to restrict fluid flow through the fluid passageway;

wherein, when the collapsible apparatus changes to the retracted configuration, the axially extending plug is either:

moved to a second position relative to the housing to allow fluid flow through the fluid passageway into an internal flow path of an axially extending tubing string; or capable of moving from the first position to allow fluid flow through the fluid passageway into the internal flow path;

wherein the collapsible apparatus comprises:

an apparatus housing forming a chamber; and a piston sized to be received in the chamber;

wherein, when the collapsible apparatus is in the extended configuration:

the piston is coupled to the apparatus housing to fluidically isolate the chamber; and the collapsible apparatus has a first axial length; and wherein, when the collapsible apparatus is in the retracted configuration:

the piston is received in the apparatus housing; and the collapsible apparatus has a second axial length that is less than the first axial length.

2. The pressure actuated inflow control device of claim 1, wherein a shearable element couples the piston to the apparatus housing and wherein the shearable element is configured to actuate at the predetermined pressure.

3. The pressure actuated inflow control device of claim 1, wherein the collapsible apparatus is at least partially manufactured using an additive manufacturing process.

4. The pressure actuated inflow control device of claim 3, wherein, when the collapsible apparatus is in the extended configuration, the piston and the apparatus housing are integrally formed as a seamless unit; and wherein a portion of the seamless unit corresponding to the piston is configured to shear relative to a remainder of the seamless unit at the predetermined pressure.

5. The pressure actuated inflow control device of claim 1, wherein, when the collapsible apparatus is in the extended configuration, the piston is attached to the axially extending plug to secure the axially extending plug at the first position relative to the housing; and wherein, when the collapsible apparatus is in the retracted configuration, the piston is at least partially detached from the axially extending plug to allow the axially extending plug to move from the first position.

6. The pressure actuated inflow control device of claim 1, wherein, when the collapsible apparatus is in the extended configuration, the piston is coupled to the axially extending plug to secure the axially extending plug at the first position relative to the housing; and wherein, when the collapsible apparatus is in the retracted configuration, the piston remains coupled to the axially extending plug to move the axially extending plug to the second position relative to the housing.

7. The pressure actuated inflow control device of claim 1, wherein the inflow control device forms a portion of the tubing string that is configured to extend within a wellbore extending within a reservoir having a reservoir pressure; and wherein the predetermined pressure is one of a predefined applied pressure within the internal flow path of the tubing string, the reservoir pressure, and a hydrostatic pressure.

8. A method of controlling a flow of a fluid through an inflow control device comprising a housing having a wall within which a first fluid passageway axially and a second fluid passageway extend, the method comprising:

disposing a first axially extending plug in a first position within the first fluid passageway to restrict fluid flow through the first fluid passageway;

securing the first axially extending plug in the first position and in an axial direction relative to the housing using a first collapsible apparatus when the first collapsible apparatus is in an extended configuration;

subjecting at least a portion of the first collapsible apparatus and at least a portion of the first axially extending plug to a predetermined pressure;

collapsing the first collapsible apparatus from the extended configuration to a retracted configuration in response to the at least a portion of the first collapsible apparatus being subjected to the predetermined pressure; and either:

moving the first axially extending plug to a second position, using the first collapsible apparatus, relative to the housing to allow fluid flow through the first fluid passageway into an internal flow path of an axially extending tubing string; or decoupling the first collapsible apparatus from the first axially extending plug such that the first collapsible apparatus and the first axially extending plug are spaced from one another to allow for the first axially extending plug to move from the first position;

wherein the first collapsible apparatus comprises:

an apparatus housing forming a chamber; and a piston sized to be received in the chamber;

wherein, when the first collapsible apparatus is in the extended configuration:

the piston is coupled to the apparatus housing to fluidically isolate the chamber; and the first collapsible apparatus has a first axial length; and wherein, when the first collapsible apparatus is in the retracted configuration:

the piston is received in the apparatus housing; and the first collapsible apparatus has a second axial length that is less than the first axial length.

9. The method of claim 8, wherein a shearable element couples the piston to the apparatus housing; and wherein collapsing the first collapsible apparatus from the extended configuration to the retracted configuration in response to the at least the portion of the first collapsible apparatus being subjected to the predetermined pressure comprises shearing the shearable element.

10. The method of claim 8, wherein the first collapsible apparatus is at least partially manufactured using an additive manufacturing process.

11. The method of claim 10, wherein, when the first collapsible apparatus is in the extended configuration, the piston and the apparatus housing are integrally formed as a seamless unit;

wherein a portion of the seamless unit corresponding to the piston is configured to shear relative to the portion of the seamless unit corresponding to the apparatus housing at the predetermined pressure; and wherein collapsing the first collapsible apparatus from the extended configuration to the retracted configuration in response to the at least the portion of the first collapsible apparatus being subjected to the predetermined pressure comprises shearing the portion of the seamless unit corresponding to the piston relative to a remainder of the seamless unit such that the piston is received within the chamber of the apparatus housing.

12. The method of claim 8, wherein the method comprises decoupling the first collapsible apparatus from the first axially extending plug to allow for the first axially extending plug to move from the first position;

wherein, when the first collapsible apparatus is in the extended configuration, the piston is coupled to the first axially extending plug to secure the first axially extending plug at the first position relative to the housing; and wherein collapsing the first collapsible apparatus from the extended configuration to the retracted configuration in response to the at least the portion of the first collapsible apparatus being subjected to the predetermined pressure comprises decoupling the first collapsible apparatus from the first axially extending plug.

13. The method of claim 8, wherein, when the first collapsible apparatus is in the extended configuration, the piston is coupled to the first axially extending plug to secure the first axially extending plug at the first position relative to the housing; and wherein the method comprises moving the first axially extending plug to the second position, using the piston of the first collapsible apparatus, relative to the housing to allow fluid flow through the first fluid passageway.

14. The method of claim 8, wherein the inflow control device forms a portion of the tubing string that is configured to extend within a wellbore extending within a reservoir having a reservoir pressure; and wherein the predetermined pressure is one of an applied pressure within the internal flow path of the tubing string, the reservoir pressure, and a hydrostatic pressure.

15. The method of claim 14, wherein the method comprises decoupling the first collapsible apparatus from the first axially extending plug to allow for the first axially extending plug to move from the first position;

wherein the predetermined pressure is the applied pressure within the internal flow path of the tubing string; and wherein the method further comprises reducing the applied pressure within the wellbore below the predetermined pressure to move the first axially extending plug from the first position.

16. The method of claim 8, wherein the chamber is one of an atmospheric chamber and a controlled pressure enclosed chamber.

17. The method of claim 14, wherein the predetermined pressure is an applied pressure within the internal flow path of the tubing string; and wherein the first axially extending plug remains disposed in the first axially extending fluid passageway at the first position after changing the first collapsible apparatus to the retracted configuration thereby maintaining the applied pressure within the wellbore at or above the predetermined pressure.

18. The method of claim 17, further comprising:

disposing a second axially extending plug in a third position within the second fluid passageway to restrict fluid flow through the second fluid passageway;

securing the second axially extending plug in the third position and in the axial direction relative to the housing using a second collapsible apparatus when the second collapsible apparatus is in an extended configuration;

subjecting at least a portion of the second collapsible apparatus and at least a portion of the second axially extending plug to the predetermined pressure;

collapsing the second collapsible apparatus from the extended configuration to the retracted configuration in response to the at least a portion of the second collapsible apparatus being subjected to the predetermined pressure; and decoupling the second collapsible apparatus from the second axially extending plug to allow for the second axially extending plug to move from the third position.

* * * * *